United States Patent [19]

Mitchell

[11] 4,161,225

[45] Jul. 17, 1979

[54] SKEWED INSERTS FOR AN EARTH BORING CUTTER

[75] Inventor: Howard E. Mitchell, Duncanville, Tex.

[73] Assignee: Dresser Industries, Inc., Dallas, Tex.

[21] Appl. No.: 930,254

[22] Filed: Aug. 2, 1978

Related U.S. Application Data

[63] Continuation of Ser. No. 858,236, Dec. 7, 1977, abandoned.

[51] Int. Cl.[2] ..... E21B 9/08

[52] U.S. Cl. ..... 175/374; 175/410; 175/53

[58] Field of Search ..... 175/374, 375, 377, 378, 175/410, 53; 299/86; 404/28

[56] References Cited

U.S. PATENT DOCUMENTS

| | | | |
|---|---|---|---|
| 1,224,287 | 5/1917 | Double | 175/365 |
| 1,691,623 | 11/1928 | Black | 175/410 X |
| 3,250,337 | 5/1966 | Demo | 175/374 |
| 3,593,812 | 7/1971 | Peterson | 175/374 |

FOREIGN PATENT DOCUMENTS

| | | | |
|---|---|---|---|
| 1514999 | 1/1968 | France | 175/410 |
| 662063 | 11/1951 | United Kingdom | 175/410 |
| 192718 | 4/1967 | U.S.S.R. | 175/410 |

*Primary Examiner*—James A. Leppink
*Assistant Examiner*—Richard E. Favreau
*Attorney, Agent, or Firm*—Eddie E. Scott

[57] ABSTRACT

An insert cutter for earth boring includes a plurality of skewed inserts for contacting the earth formations being bored. At least one annular row of tungsten carbide inserts are positioned in the cutter body. Each insert has an elongated body and a formation contacting head. The elongated body is mounted in a socket in the cutter body and the formation contacting head projects from the cutter body. The inserts are installed on the cutter body such that the inserts axes are angularly offset between one-half to thirty degrees from the rotational axis of the cutter.

2 Claims, 3 Drawing Figures

SKEWED INSERTS FOR AN EARTH BORING CUTTER

This is a continuation, of application Ser. No. 858,236, filed Dec. 7, 1977, now abandoned.

BACKGROUND OF THE INVENTION

The present invention relates to the art of earth boring and, more particularly, to an insert cutter having skewed inserts for contacting the formations being bored. The present invention may be advantageously used on tunneling machines, continuous mining machines, raise drills, rock bits, and other types of earth boring bits, cutters and machines. A cutter constructed in accordance with the present invention is rotatably connected to the bit or the rotary head of the earth boring machine and serves to contact and cut the formations being bored.

Insert type earth boring cutters include hard insert elements mounted in sockets in the cutter member body. The earth boring cutters are utilized in the boring of holes in the earth. The hard insert elements have the ability to penetrate earth formations; however, the cyclic loading due to cutter rotation during drilling imposes high unit loading on the insert elements, the sockets and the cutter member body. Such high unit loading can lead to failure of the cutter. In prior art cutters the axes of the inserts have been radially aligned with the axis of rotation of the cutter. The present invention provides an insert cutter having insert elements whose axes are skewed to the axis of rotation of the cutter.

DESCRIPTION OF THE PRIOR ART

A general understanding of the prior art relating to insert cutters may be obtained from a consideration of the disclosures of the following U.S. Patents. In U.S. Pat. No. 3,570,613, patented Mar. 16, 1971, a gage cutter is shown. The gage cutter is for use with a tunneler or mine machine or the like having a plurality of rows of cutter elements about the periphery thereof, the rows being of such size and positioning as to define an oblate cylinder cutting enevelope or plane to equalize the loading on the cutting elements. In U.S. Pat. No. 3,134,447 to F. H. McElya, patented May 26, 1964, a rolling cone rock bit with wraparound spearpoints is shown. A rock bit is shown having a multiplicity of rolling cone cutters mounted thereon with their axes of rotation inclined downwardly and inwardly with respect to the axis of rotation of the bit. Each cutter has a conical nose at its small end terminating adjacent but short of said bit axis. The nose has inserts of wear resistant material protruding therefrom with blunt cutting tips. Such inserts are disposed and distributed between cutters to roll through adjacent and overlapping annuli, the innermost such annulus being defined by an insert from the apex of one of said conical noses.

In U.S. Pat. No. 3,547,209, patented Dec. 15, 1970, a deviation control bit and method is shown. The patent discloses method and apparatus for controlling natural hole deviation of a drill string and bit wherein the bit teeth wedges are designed to eliminate or substantially reduce the formation reactive forces that cause the bit to deviate from the vertical as drilling is carried out. Such design permits the use of substantially greater drilling weights than those utilized in prior art systems for a given bit type and formation hardness.

In U.S. Pat. No. 1,691,628, patented Nov. 13, 1928, a well drilling tool is shown. This patent does not show an insert type cutter. Instead the patent shows a self-sharpening rotary disc cutter for rotary earth boring drills comprising a single metal disc and circumferentially spaced pads of harder metal than the metal of the disc arranged on one side of the disc at the cutting edge. In FIGS. 4 and 5 the disc is provided on its rear face with a plurality of ribs extending inward from the peripheral surface, the ribs in this instance being inclined to the radius.

SUMMARY OF THE INVENTION

The present invention provides an insert cutter having a plurality of skewed inserts for contacting the formations being bored. At least one annular row of inserts is positioned in the cutter body. Each insert has an elongated body and a formation contacting head. The elongated body is mounted in a socket in the cutter body and the formation contacting head projects from the cutter body. The inserts are angularly skewed from the axis of rotation of the cutter body. The aforementioned features and advantages of the present invention and other features and advantages will become apparent from a consideration of the following detailed description of the invention when taken in conjunction with the accompanying drawings.

DETAILED DESCRIPTION OF THE INVENTION

Figure 1:
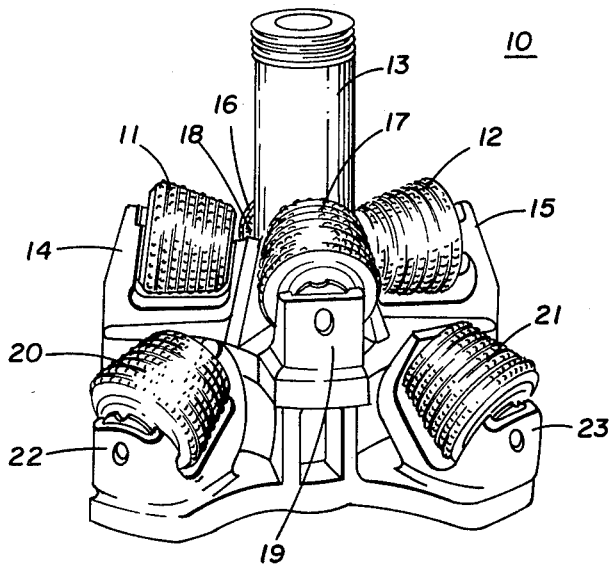
FIG. 1 shows an earth boring bit for boring a large diameter hole.

Referring now to FIG. 1, an embodiment of an earth boring bit is shown generally at 10. This type of bit is sometimes referred to as a "raise bit" because of its extensive use in boring raise holes between levels of an underground mine. The term "raise" may have been applied to this type of operation because a pilot hole is drilled from one level of a mine down to another level and the hole enlarged by a raising operation on the upward pass. The present invention may be used with bits for boring raise holes and in other operations wherein an earth borehole is desired. This may include boring at any angle to the horizontal either up or down and with or without a pilot hole.

Many strict requirements are imposed upon a bit to be used in boring holes through earth formations. The bit must be a balanced high-performance apparatus that is rugged and will perform for a long period of time. It is desirable to have a majority of the elements wear out at about the same time without premature failure of any one element. The bit is repeatedly subjected to high stress and the particular geometry of the bit imposes limitations upon the structural elements that are exposed to the stress and the elements that will carry the stress.

In bits of this character, it has been found desirable to employ a number of small rolling or rotatable cutters rotatably mounted on a main bit body. The cutters are located and spaced so that upon rotation of the bit every portion of the hole being drilled will be acted upon by one or more of the cutters to disintegrate the formations. This insures that almost the entire wear of drilling takes place on the cutters rather than on the main bit body. The cutters may be readily replaceable thereby allowing the life of the bit to be extended by replacing the cutters.

As shown in FIG. 1, two small inner cutters 11 and 12 are positioned next to the central shaft 13 and function as the first cutting stage. At least two cutters are used to insure a balanced drilling bit and a smooth drilling operation. Cutters 11 and 12 are held in position by saddles 14 and 15 which are mounted on central shaft 13. The saddles 14 and 15 allow the cutters to be easily removed and new cutters inserted. An example of a removable cutter and saddle system is shown in U.S. Pat. No. 3,203,492 to C. L. Lichte, patented Aug. 31, 1965. A second cutting stage is located next to the first stage and includes two cutters 16 and 17 mounted in saddles 18 and 19. A third cutting stage is located slightly below the first and second cutting stages. The third stage includes a multiplicity of cutters such as cutters 20 and 21 mounted in saddles 22 and 23.

In operation, the central shaft 13 extends through a pilot hole having a diameter slightly larger than the diameter of shaft 13. The bit 10 is rotated by means of a system well known in the art. As bit 10 rotates the cutters 11, 12, 16, 17, 20, 21, etc. contact and disintegrate the formation as the bit is moved along the pilot hole. The cutting surfaces of the cutters must traverse substantially the entire surface of the hole being bored and the saddles and other portions of the bits should not contact the formations being drilled.

Figure 2:
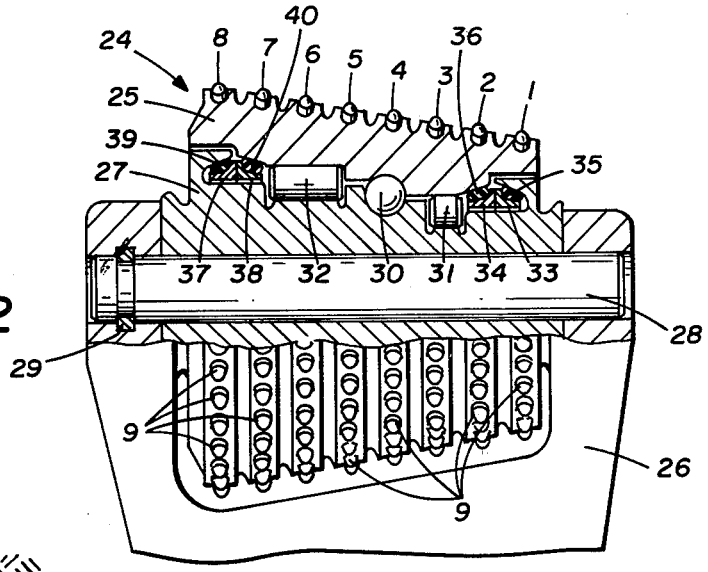
FIG. 2 is an illustrative view of an insert cutter constructed in accordance with the present invention positioned in a saddle that is adapted to be connected to the rotary head of the earth boring bit shown in FIG. 1.

Referring now to FIG. 2, the operation of a cutter constructed in accordance with the present invention is illustrated. The cutter, generally designated by the reference number 24, includes a multiplicity of tungsten carbide inserts arranged to form a series of annular rows. The individual inserts are mounted in a cutter shell 25. The cutter shell 25 is rotatably mounted in a saddle 26. The saddle 26 may be connected to the rotary head of an earth boring machine or to the body of an earth boring bit such as that shown in FIG. 1. The annular rows of inserts act upon the formations to form the desired hole by continually cutting the earth formations being bored, thereby fracturing the formations and causing fragments of the formations to be separated from the formations being bored. The cutting action of an "insert cutter" or "button cutter" has been described by Frank F. Roxborough and Alan Rispin in the article, "The Mechanical Cutting Chracteristics of the Lower Chalk" in *Tunnels and Tunneling*, January 1973 as follows:

> "This is very much a grinding tool. It usually takes the form of a free rolling cylinder or cone frustum, the surface of which is studded with tungsten carbide buttons. It is operated in a similar fashion to the disc and roller cutter. A high penetrating force into the rock surface, supplemented by a translatory motion to the tool, causes rock degradation by grinding and pulverisation."

The cutting inserts in earth boring cutters, normally are made of tungsten carbide material and are designed to function best when the load applied is perpendicular to the axis of the insert, i.e. a pure compressive load. Loads, or components of loads, which are not applied in this manner tend to shorten life of the earth boring cutter by causing premature breakage or loss of the cutting inserts. It is therefore an object of this invention to prevent this type of premature failure by installing the inserts in a manner that will minimize components of loads which are not perpendicular to the axis.

Referring again to FIG. 2, the structural details of an embodiment of a cutter constructed in accordance with the present invention is illustrated. The cutter 24 includes a multiplicity of carbide inserts arranged to form a series of annular rows 1 through 8. The cutter 24 includes a large number of individual sintered tungsten carbide inserts, each designated by the reference numeral 9, mounted in the cutter shell 25. The cutter shell 25 is positioned around a bearing shell 27 and bearing shell 27 is securely locked in the saddle 26. The saddle 26 may be connected to the rotary head of an earth boring machine or to the body of an earth boring bit such as the bit 10 shown in FIG. 1. It is to be understood that the cutter 24 could also be in the form of a conical cutter adapted to be rotatably mounted on one of the arms of a rotary rock bit. It is also to be understood that the cutter 24 could be constructed to include a single annular row of inserts and that the cutter 24 could cooperate with another cutter to fracture the formations.

The bearing shell 27 is locked in position in the saddle 26 by a main pin 28 and a retainer nail or roll pin 29. The bearing shell 27 remains firmly locked in place throughout the drilling operation due to a tenon and groove arrangement disclosed in U.S. Pat. No. 3,203,492 to C. L. Lichte patented Aug. 31, 1965. A multiplicity of bearing systems including a series of ball bearings 30, a series of inner roller bearings 31 and a series of outer roller bearings 32 promote rotation of the cutter shell 25 about the bearing shell 27. Lubricant is retained in the bearing area by two sets of seal elements. The inner set of seal elements includes a pair of annular metal seal rings 33 and 34 that are positioned near the inner end of the cutter 24. A flexible rubber O-ring 35 is positioned between seal ring 33 and the bearing shell 27 to retain the seal ring 33 in the desired position and resiliently urge seal ring 33 against seal ring 34. A flexible rubber O-ring 36 is positioned between the cutter shell 25 and the seal ring 34 to retain the seal ring 34 in the desired position and resiliently urge the seal ring 34 against seal ring 33. The outer set of seal elements includes a pair of annular metal seal rings 37 and 38 that are positioned near the outer end of the cutter 24. A flexible rubber O-ring 39 is positioned between the seal ring 37 and bearing shell 27 to retain the seal ring 37 in the desired position and resiliently urge seal ring 37 against seal ring 38. A flexible rubber O-ring 40 is positioned between the cutter shell 25 and seal ring 38 to retain seal ring 38 in the desired position and resiliently urge seal ring 38 against seal ring 37.

The cutting inserts 9 are installed in the earth boring cutter 24 in a skewed manner with respect to the center of rotation of the cutter 24. The angle of skew (offset) is such that when the insert has penetrated the formation and is at its maximum load, just prior to spalling or chipping of the formation, this load is aligned with the axis of the insert.

The structural details of a cutter 24 constructed in accordance with the present invention having been described, the operation of the cutter 24 will now be considered. The saddle 26 is connected to a rotary drilling head or bit and the head or bit is rotated and moved through the formations. The inserts 9 contact the formations and the portions of the formations tend to fracture out and the fragments are separated from the formations being bored to form the desired hole or tunnel. The heads of the inserts 9 come into contact with the formations. The inserts 9 are positioned in the cutter 24 such that the center line (central axis) of the inserts 9 do not pass through the center of rotation (central axis) of the cutter. The angle of skew changes as the design of the cutter changes, depending on such variables as insert diameter, extension, shape, and spacing. These variables are generally fixed by the type of formation that the cutter is intended to cut. The angle of skew can be as little as one-half degree for cutters designed for extremely hard formations, or as great as thirty degrees for cutters designed for extremely soft formations.

Figure 3:
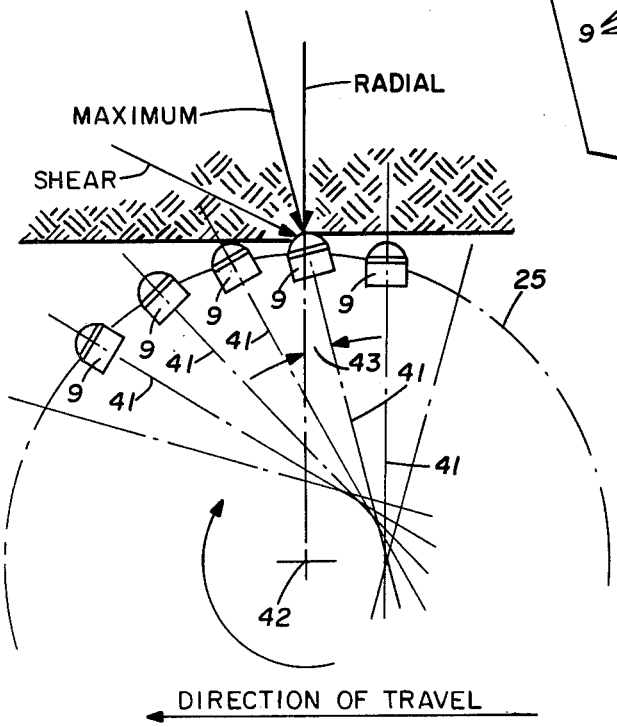
FIG. 3 is a schematic illustration of the force loading of the inserts of the cutter shown in FIG. 2.

Referring now to FIG. 3, a schematic diagram of an end view of a portion of the cutter shell 25 is shown. Adjacent inserts 9 are shown positioned in the cutter shell 25. Each of the inserts 9 have an elongated body portion positioned in a socket in the cutter shell 25 and a formation contacting head that is adapted to contact the formations. The inserts 9 are installed in the cutter shell 25 such that the insert axes 41 are angularly offset at an angle 43 from the rotational axis 42 of the cutter in a direction opposite the direction of rotation of the cutter and toward the direction of travel of the cutter. In other words, the inserts 9 are angularly skewed in a direction "lagging" the cutter rotation. The angle of skew 43 (offset) is such that when the insert 9 has penetrated the formation and is at its maximum load, just prior to spalling or chipping of the formation, this load is aligned with the axis of the insert. The angle of skew 43 changes as the design of the cutter 24 changes, depending on such variables as insert diameter, extension, shape, and spacing. These variables are generally fixed by the type of formation that the cutter 24 is intended to cut. The angle of skew 43 can be as little as one-half degree for cutters designed for extremely hard formations, or as great as thirty degrees for cutters designed for extremely soft formations. The radial force and shear forces are shown as they act on the insert 9. The skew angle 43 is chosen so that the maximum force will act aligned with the central axis 41 of the insert 9.

The embodiments of the invention in which an exclusive property or privilege is claimed are defined as follows:

1. An earth boring bit with a cutter having a rotational axis and individual cutting inserts and being adapted to be moved along earth formations causing the inserts to engage the formations and the cutter to rotate in a rotational direction, thereby imposing a radial force from said formations onto said inserts acting perpendicular to said rotational axis of said cutter and a shear force from said formations onto said inserts acting at an angle to said radial force, said radial force and shear force producing a maximum force that imposes a maximum load on said inserts, comprising:

an earth boring bit body;

a cutter body rotatably mounted on said earth boring bit body, said cutter body containing said rotational axis; and at least one annular row of inserts projecting from said cutter body for engaging the earth formations, each of said inserts having a central axis that is angularly offset from the rotational axis of the cutter, said inserts being angularly offset in a direction opposite to said rotational direction of the cutter so that said central axis of each of said inserts is substantially aligned with said maximum force when the insert has penetrated the earth formations and is at its maximum load just prior to spalling or chipping of the formations.

2. An earth boring bit with a cutter having a rotational axis and individual inserts and being adapted to be moved along earth formations in a cutter direction of travel causing the inserts to engage the formations and the cutter to rotate in a rotational direction, thereby imposing a radial force from said formations onto said inserts acting perpendicular to said rotational axis of said cutter and a shear force from said formations onto said inserts acting at an angle to said radial force, said radial force and shear force producing a maximum force that imposes a maximum load on said inserts, comprising:

an earth boring bit body;

a cutter body rotatably mounted on said earth boring bit body, said cutter body containing said rotational axis; and at least one annular row of inserts projecting from said cutter body for engaging the earth formations, each of said inserts having a central axis that is angularly offset from the rotational axis of the cutter, said inserts being angularly offset in a direction opposite to said rotational direction of the cutter and in the cutter direction of travel so that said central axis of each of said inserts in substantially aligned with said maximum force when the insert has penetrated the earth formations and is at its maximum load, just prior to spalling or chipping of the formations.

* * * * *